US011389945B1

(12) United States Patent
Kao

(10) Patent No.: US 11,389,945 B1
(45) Date of Patent: Jul. 19, 2022

(54) TOOL HOLDING FRAME

(71) Applicant: Jui Chien Kao, Taichung (TW)

(72) Inventor: Jui Chien Kao, Taichung (TW)

( * ) Notice: Subject to any disclaimer, the term of this patent is extended or adjusted under 35 U.S.C. 154(b) by 0 days.

(21) Appl. No.: 17/461,883

(22) Filed: Aug. 30, 2021

(51) Int. Cl.

| | |
|---|---|
| ***B25H 3/00*** | (2006.01) |
| ***B25H 3/04*** | (2006.01) |
| ***A47F 7/00*** | (2006.01) |
| *B25H 3/06* | (2006.01) |

(52) U.S. Cl.
CPC ..... *B25H 3/04* (2013.01); *B25H 3/003* (2013.01); *B25H 3/06* (2013.01)

(58) Field of Classification Search
CPC ..... B25H 3/04; B25H 3/003; B25H 3/06
See application file for complete search history.

(56) References Cited

U.S. PATENT DOCUMENTS

| | | | | |
|---|---|---|---|---|
| 5,467,874 | A * | 11/1995 | Whitaker | B25H 3/06 248/309.2 |
| 9,527,206 | B1 * | 12/2016 | Hsieh | B25H 3/04 |
| 10,272,547 | B1 * | 4/2019 | Lai | B25H 3/04 |
| D867,087 | S * | 11/2019 | Kao | D8/71 |
| 11,091,778 | B2 * | 8/2021 | Winnard | A61K 39/205 |
| 11,135,713 | B2 * | 10/2021 | Kao | B65D 73/00 |
| 2003/0222036 | A1 * | 12/2003 | Lacombe | B25H 3/003 211/70.6 |
| 2015/0202767 | A1 * | 7/2015 | Kao | F16M 13/022 211/70.6 |
| 2016/0271788 | A1 * | 9/2016 | Hsieh | B25H 3/04 |
| 2020/0016736 | A1 * | 1/2020 | Kao | B25H 3/003 |
| 2020/0101590 | A1 * | 4/2020 | Winnard | C12N 15/86 |
| 2020/0406447 | A1 * | 12/2020 | Hsieh | B25H 3/04 |
| 2021/0339376 | A1 * | 11/2021 | Winnard | B25H 3/003 |

* cited by examiner

*Primary Examiner* — Kimberley S Wright
(74) *Attorney, Agent, or Firm* — Hershkovitz & Associates, PLLC; Abe Hershkovitz

(57) ABSTRACT

A tool holding frame has a track base and at least one protective pad. The track base is made of metal and has a lower portion having two engaging tabs. The at least one protective pad is made of plastic and is engaged with the two engaging tabs of the lower portion. Each of the at least one protective pad has two engaging portions respectively engaged with the two engaging tabs. Each of the two engaging portions has a bottom segment abutting against a bottom of a corresponding one of the two engaging tabs and at least one hook engaged with the corresponding one of the two engaging tabs. Each of the at least one hook has a connection segment and a hooking protrusion spaced from the bottom segment to form an engaging groove therebetween and abutting against a top of the corresponding one of the two engaging tabs.

9 Claims, 12 Drawing Sheets

TOOL HOLDING FRAME

BACKGROUND OF THE INVENTION

1. Field of the Invention

The present invention relates to a tool holding frame, and more particularly to a tool holding frame that has at least one protective pad to prevent the tool holding frame from scratching a surface of a table when put on the table.

2. Description of the Prior Art

A conventional tool holding frame comprises a track base made of a metallic material and multiple holding bases mounted on the track base for holding tools, e.g. sockets. However, because the track base is made of a metallic material, e.g. by aluminum extrusion, when the conventional tool holding frame is placed on a table, a surface of the table will be easily scratched by the track base of the conventional tool holding frame.

To overcome the shortcomings, the present invention provides a tool holding frame to mitigate or obviate the aforementioned problems.

SUMMARY OF THE INVENTION

The main objective of the present invention is to provide a tool holding frame that has at least one protective pad to prevent the tool holding frame from scratching a surface of a table when put on the table.

The tool holding frame comprises a track base and at least one protective pad. The track base is elongated, is made of metal, and has a base being elongated and a lower portion formed on a bottom of the base and extending along a lengthwise direction of the base. The lower portion has two engaging tabs formed on a bottom of the lower portion, extending along the lengthwise direction of the base, extending toward each other, spaced from the base to form two lower channels respectively between the base and the two engaging tabs, and spaced from each other to form a bottom opening between the two engaging tabs.

The at least one protective pad is made of plastic, is slidably mounted on the bottom of the lower portion, and is engaged with the two engaging tabs of the lower portion of the track base. Each of the at least one protective pad has a body and two engaging portions respectively formed on two opposite sides of the body and respectively engaged with the two engaging tabs of the lower portion. Each of the two engaging portions has a bottom segment and at least one hook. The bottom segment extends away from the other one of the two engaging portions and abuts against a bottom of a corresponding one of the two engaging tabs of the lower portion.

The at least one hook is formed on a top of the bottom segment, and is engaged with the corresponding one of the two engaging tabs of the lower portion. Each of the at least one hook has a connection segment formed on the top of the bottom segment and a hooking protrusion formed on a top of the connection segment, extending from the connection segment and away from the other one of the two engaging portions, spaced from the bottom segment of the engaging portion to form an engaging groove between the bottom segment and the hooking protrusion of each of the at least one hook of each of the two engaging portions, and abutting against a top of the corresponding one of the two engaging tabs of the lower portion to engage with the corresponding one of the two engaging tabs of the lower portion.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
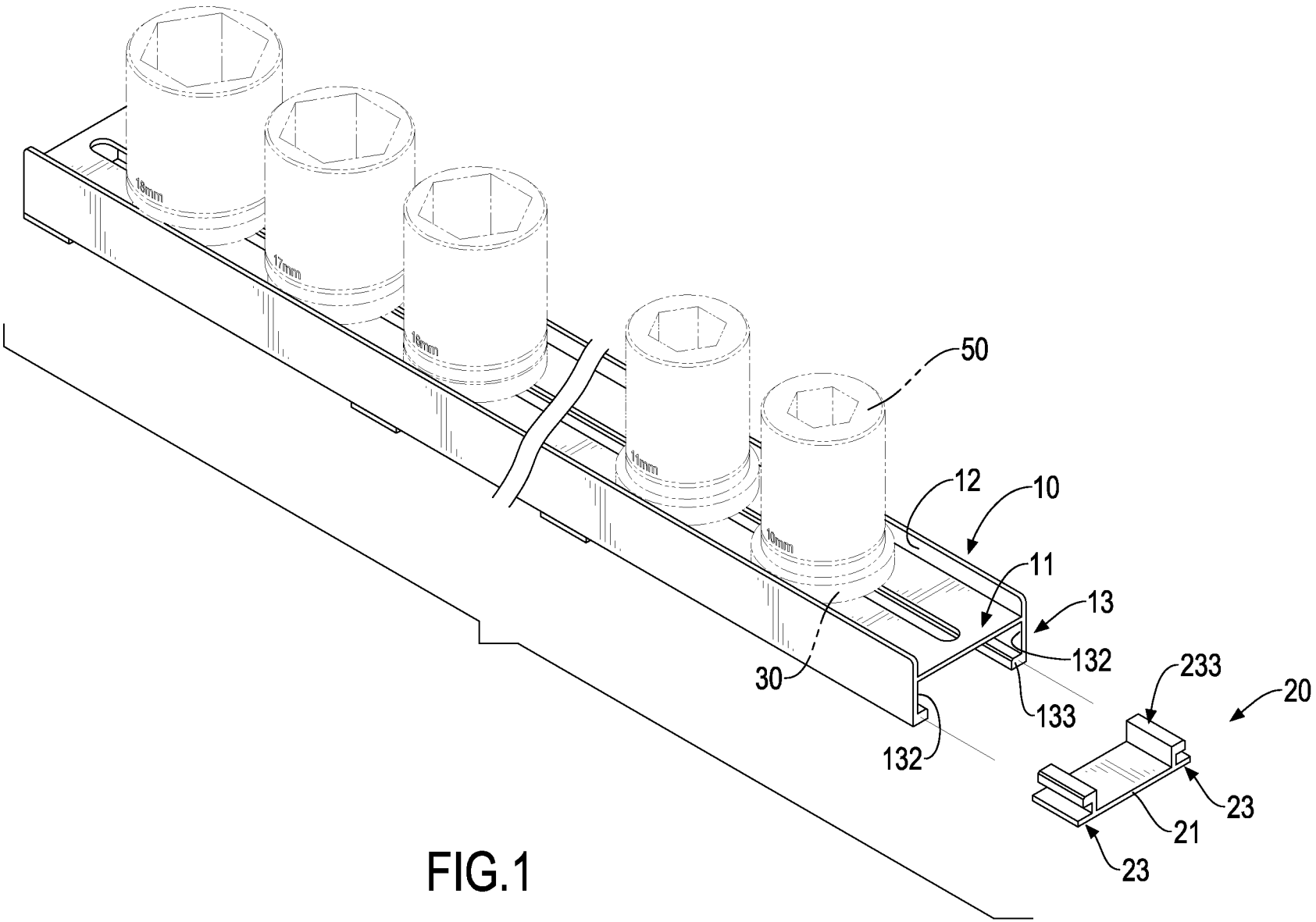
FIG. 1 is an operational perspective view of a first embodiment of a tool holding frame in accordance with the present invention.
Figure 2:
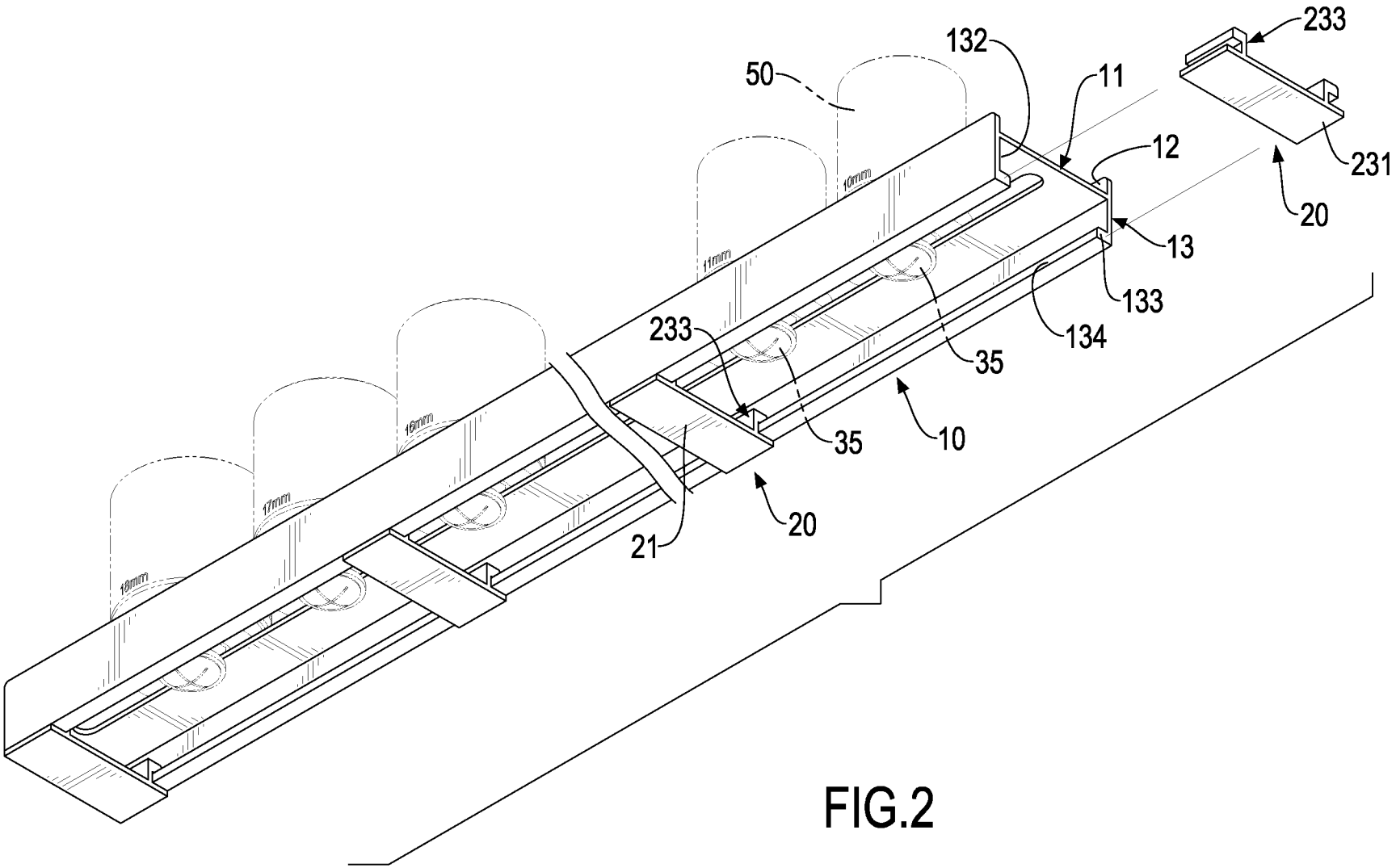
FIG. 2 is another operational perspective view of the first embodiment of the tool holding frame in FIG. 1.
Figure 3:
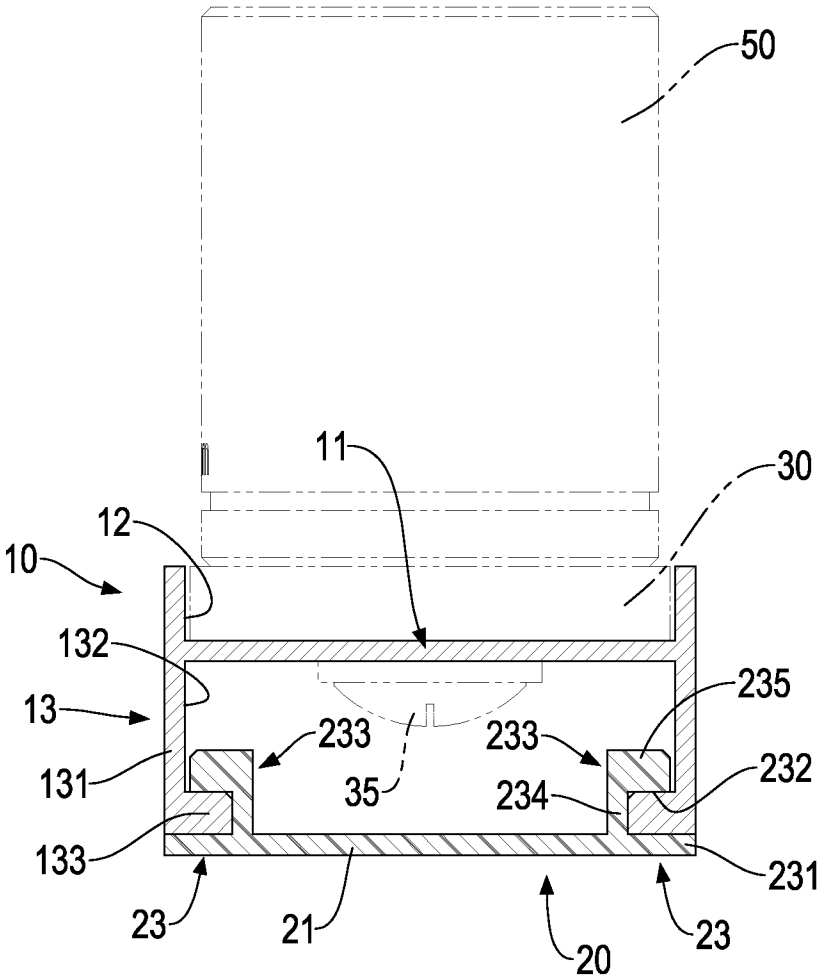
FIG. 3 is an operational side view in partial section of the first embodiment of the tool holding frame in FIG. 1.
Figure 4:
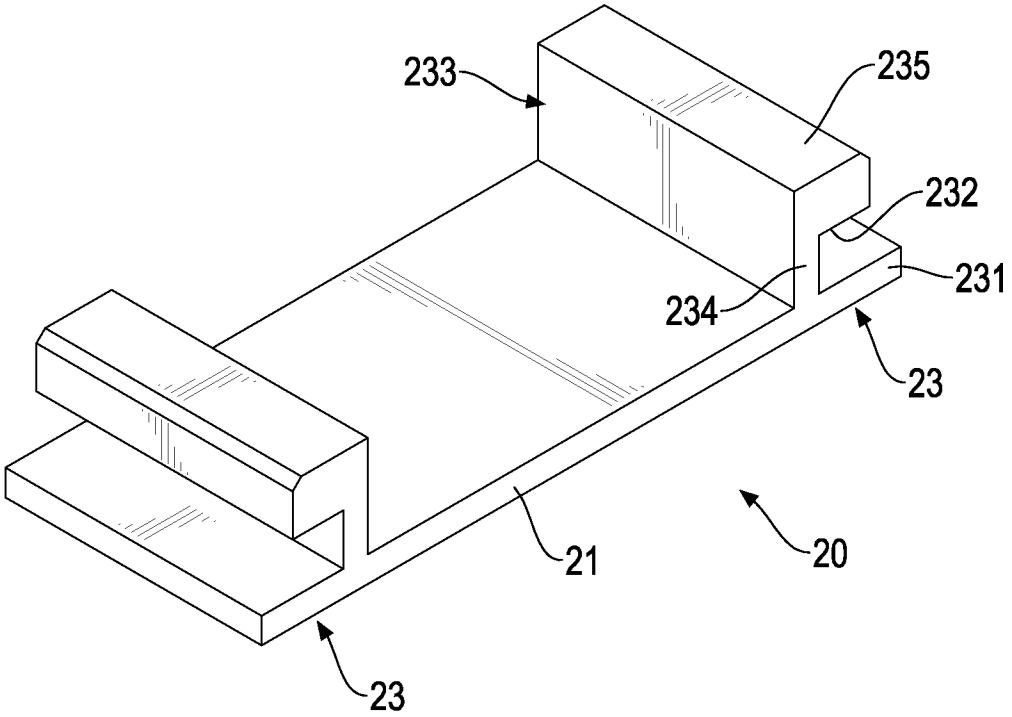
FIG. 4 is a perspective view of a protective pad of the first embodiment of the tool holding frame in FIG. 1.
Figure 5:
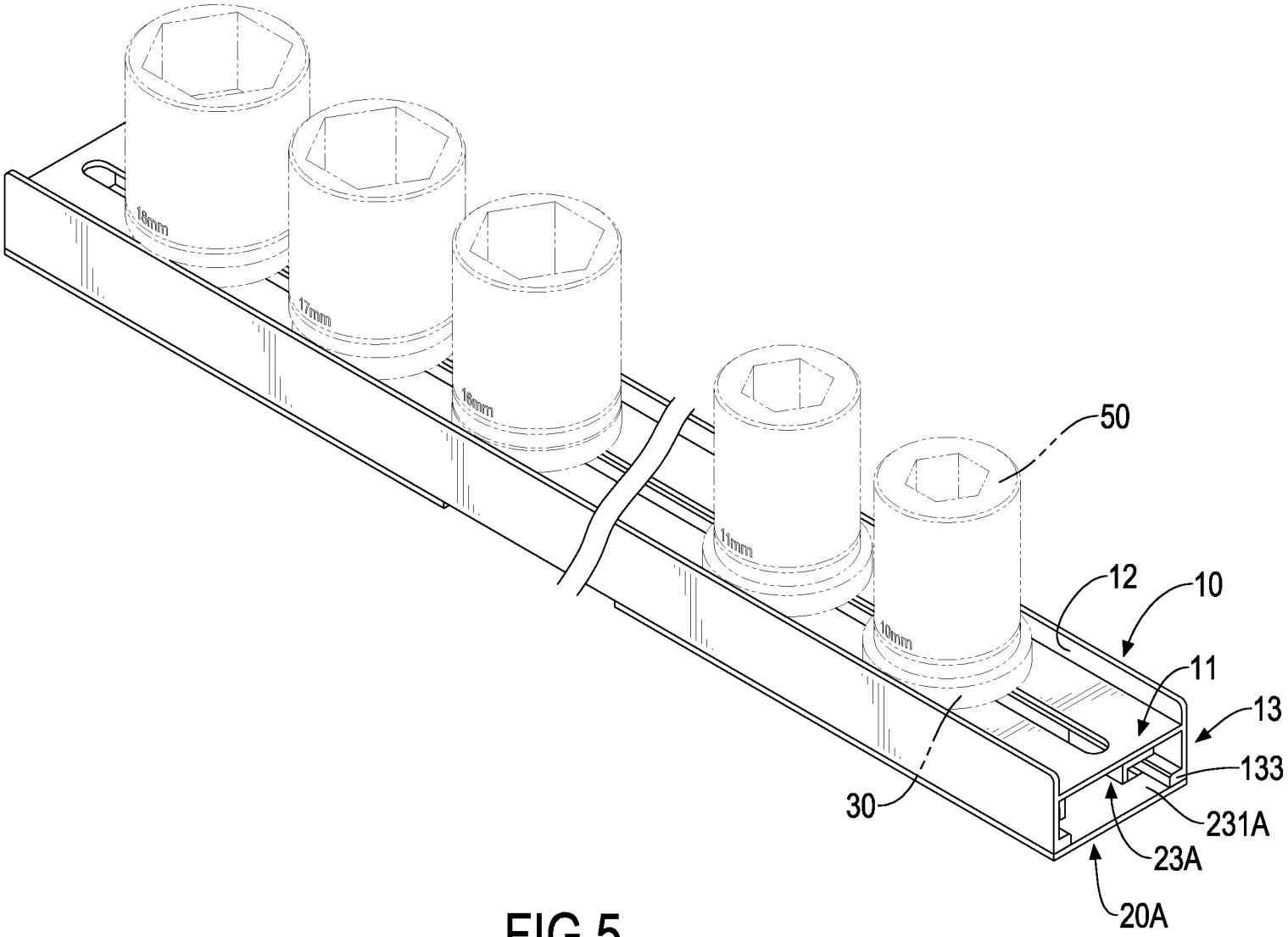
FIG. 5 is an operational perspective view of a second embodiment of a tool holding frame in accordance with the present invention.
Figure 6:
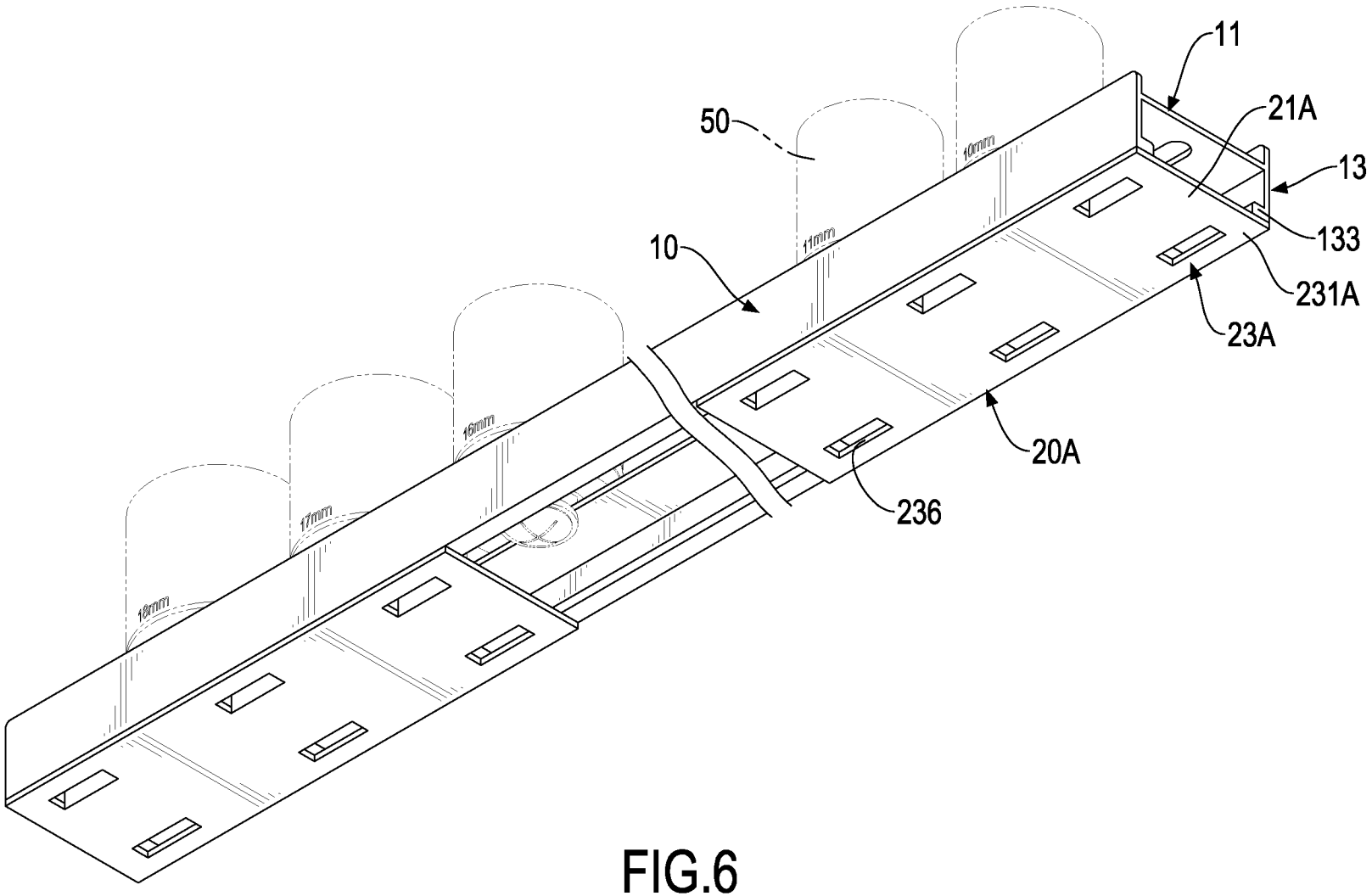
FIG. 6 is another operational perspective view of the second embodiment of the tool holding frame in FIG. 5.
Figure 7:
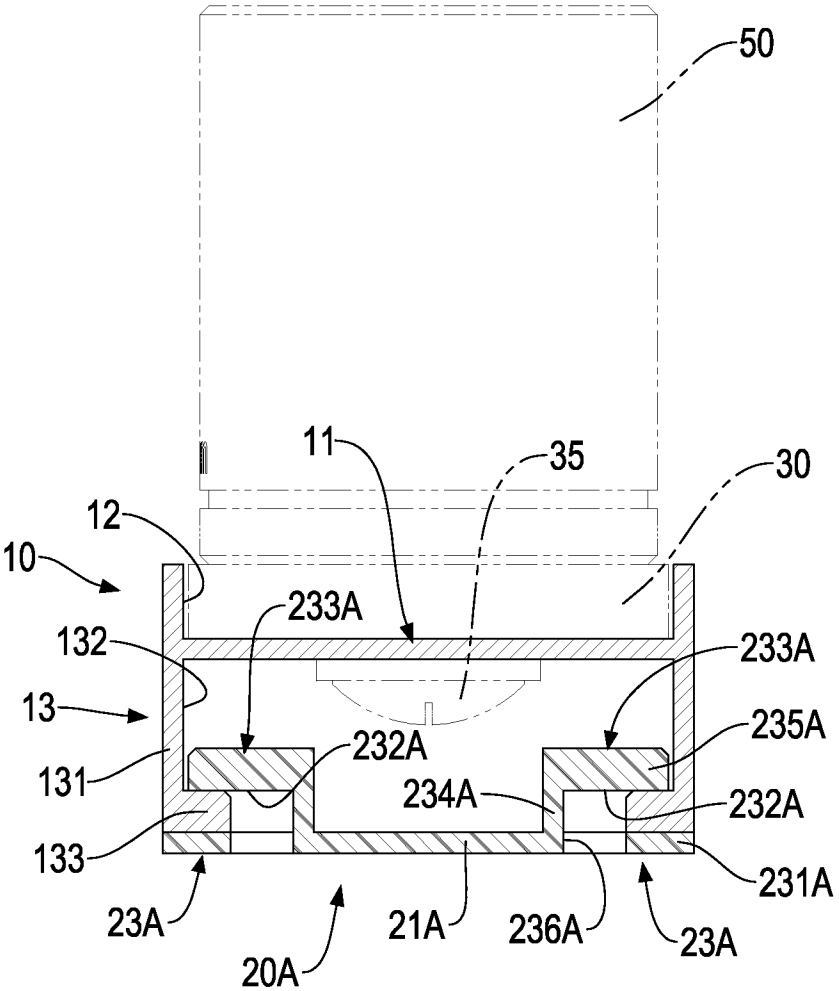
FIG. 7 is an operational side view in partial section of the second embodiment of the tool holding frame in FIG. 5.
Figure 8:
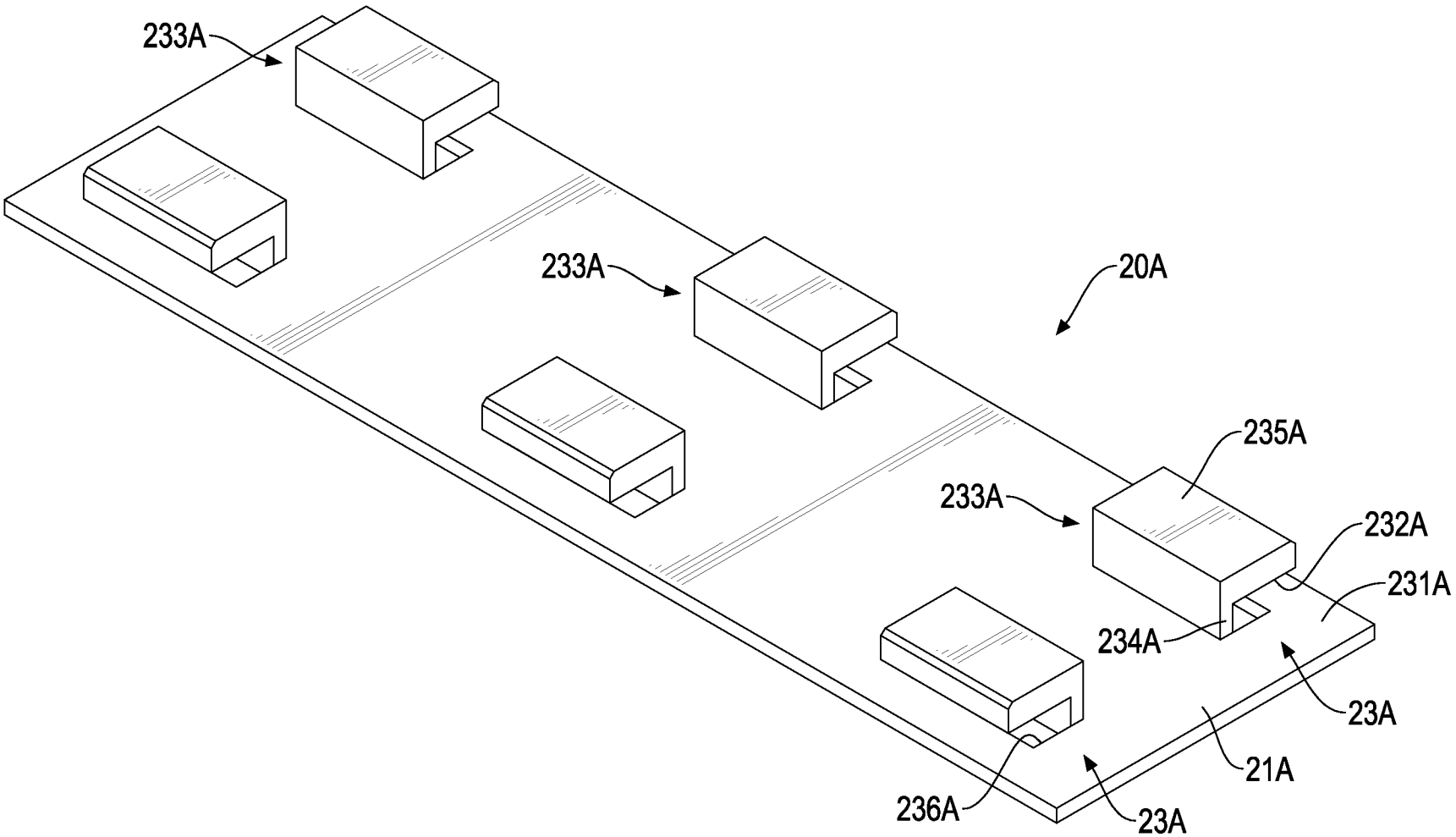
FIG. 8 is a perspective view of a protective pad of the second embodiment of the tool holding frame in FIG. 5.

With reference to FIGS. 1 to 4, a first embodiment of a tool holding frame in accordance with the present invention comprises a track base 10 and at least one protective pad 20.

The track base 10 is elongated and is made of metal, e.g. by aluminum extrusion. The track base 10 comprises a base 11 and a lower portion 13. The base 11 is elongated and has a track channel 12 defined in a top of the base 11. Multiple holding bases 30 are slidably and rotatably mounted in the track channel 12 of the base 11. Each of the holding bases 30 is fixed in the track channel 12 via a fastener 35 (e.g. screw) mounted through the base 11 from a bottom of the base 11 to screw into a bottom of the holding base 30 and is adapted to connect with a socket 50.

The lower portion 13 is formed on the bottom of the base 11, extends along a lengthwise direction of the base 11, and has two engaging tabs 133. The two engaging tabs 133 are formed on a bottom of the lower portion 13, extend along the lengthwise direction of the base 11, extend toward each other, are spaced from the base 11 to form two lower channels 132 respectively between the two engaging tabs 133 and the base 11, and are spaced from each other to form a bottom opening 134 between the two engaging tabs 133. The two lower channels 132 and the bottom opening 134 are formed through two opposite ends of the lower portion 13. Each of the two engaging tabs 133 may have a flat end or a round end. The lower portion 13 has two side panels 131 extending downwardly from the bottom of the base 11 and spaced from each other. The two engaging tabs 133 are respectively formed on bottoms of the two side panels 131 and extend toward each other.

The at least one protective pad 20 is made of plastic, is slidably mounted on the bottom of the lower portion 13 from one of the two opposite ends of the lower portion 13, is engaged with the two engaging tabs 133 of the lower portion 13 of the track base 10, and has a body 21 and two engaging portions 23. The two engaging portions 23 are respectively formed on two opposite sides of the body 21 of the at least one protective pad 20 and are respectively engaged with the two engaging tabs 133 of the lower portion 13. Each of the two engaging portions 23 has a bottom segment 231 and at least one hook 233.

The bottom segment 231 of each of the two engaging portions 23 extends away from the other one of the two engaging portions 23 and abuts against a bottom of a corresponding one of the two engaging tabs 133 of the lower portion 13. The at least one hook 233 is formed on a top of the bottom segment 231, and is engaged with the corresponding one of the two engaging tabs 133 of the lower portion 13.

Each of the at least one hook 233 has a connection segment 234 and a hooking protrusion 235. The connection segment 234 is formed on the top of the bottom segment 231. The hooking protrusion 235 is formed on a top of the connection segment 234 and extends from the connection segment 234 and away from the other one of the two engaging portions 23. The hooking protrusion 235 is spaced from the bottom segment 231 of the engaging portion 23 to form an engaging groove 232 between the bottom segment 231 and the hooking protrusion 235 of each of the at least one hook 233. The hooking protrusion 235 extends into the lower channel 132 formed between the corresponding one of the two engaging tabs 133 and the base 11 and abuts against a top of the corresponding one of the two engaging tabs 133 of the lower portion 13 to engage with the corresponding one of the two engaging tabs 133 of the lower portion 13. In other words, each of the two engaging tabs 133 of the lower portion 13 is engaged in the engaging groove 232 formed between the bottom segment 231 and the hooking protrusion 235 of the at least one hook 233 of a corresponding one of the two engaging portions 23.

With reference to FIGS. 1 to 4, in the first embodiment of the tool holding frame, the tool holding frame comprises a track base 10 and multiple protective pads 20. The multiple protective pads 20 are engaged with the two engaging tabs 133 of the lower portion 13 of the track base 10 and are arranged at spaced intervals. Each of the two engaging portions 23 of each of the protective pads 20 has a bottom segment 231 and a hook 233. Bottom surfaces of the bottom segments 231 of the two engaging portions 23 are aligned with a bottom surface of the body 21. A length from an end of the bottom segment 231 of the hook 233 of each of the two engaging portions 23 to the connection segment 234 of the hook 233 is larger than a length from an end of the hooking protrusion 235 of the hook 233 to the connection segment 234 of the hook 233. The ends of the bottom segment 231 of the hooks 233 of the two engaging portions 23 are respectively aligned with two opposite side edges of the lower portion 13 of the track base 10.

Each of the protective pads 20 can be mounted on the bottom of the lower portion 13 from one of the two opposite ends of the lower portion 13 to engage the two engaging portions 23 of each of the protective pads 20 with the two engaging tabs 133 of the lower portion 13. The protective pads 20 can be slid along the two engaging tabs 133 to adjust positions of the protective pads 20 relative to the track base 10.

Because each of the two engaging portions 23 has a bottom segment 231 located below the corresponding one of the two engaging tabs 133, when the tool holding frame is placed on a table, the protective pads 20 made of plastic contact a table surface of the table to prevent the metal track base 10 scratching the table surface.

With reference to FIGS. 5 to 8, in the second embodiment of the tool holding frame, each of the protective pads 20A is elongated and extends along the track base 10. Each of the two engaging portions 23A of each of the protective pads 20A has a bottom segment 231A being elongated and extending along the lengthwise direction of the base 11 and multiple hooks 233A arranged along the bottom segment 231A at spaced intervals and aligned with each other. Each of the hooks 233A has a connection segment 234A formed on the top of the bottom segment 231A and a hooking protrusion 235A spaced from the bottom segment 231A to form an engaging groove 232A between the hooking protrusion 235A and the bottom segment 231A. The engaging grooves 232A of the hooking protrusion 235A of the hooks 233A of each of the two engaging portions 23A communicate with each other. Each of the two engaging portions 23A of each of the protective pads 20A is engaged with the corresponding one of the two engaging tabs 133 of the lower portion 13 via the multiple hooks 233A thereof.

In addition, the bottom segment 231A of each of the two engaging portions 23A may have multiple openings 236A formed through the bottom segment 231A and respectively aligned with the hooking protrusions 235A of the hooks 233A of each of the two engaging portions 23A. A length of each of the openings 236A is smaller than a length of the hooking protrusion 235A.

Because the bottom segments 231A of the two engaging portions 23A of each of the protective pads 20A are elongated, an amount of the protective pads 20A mounted on the bottom of the lower portion 13 can be decreased.

Figure 9:
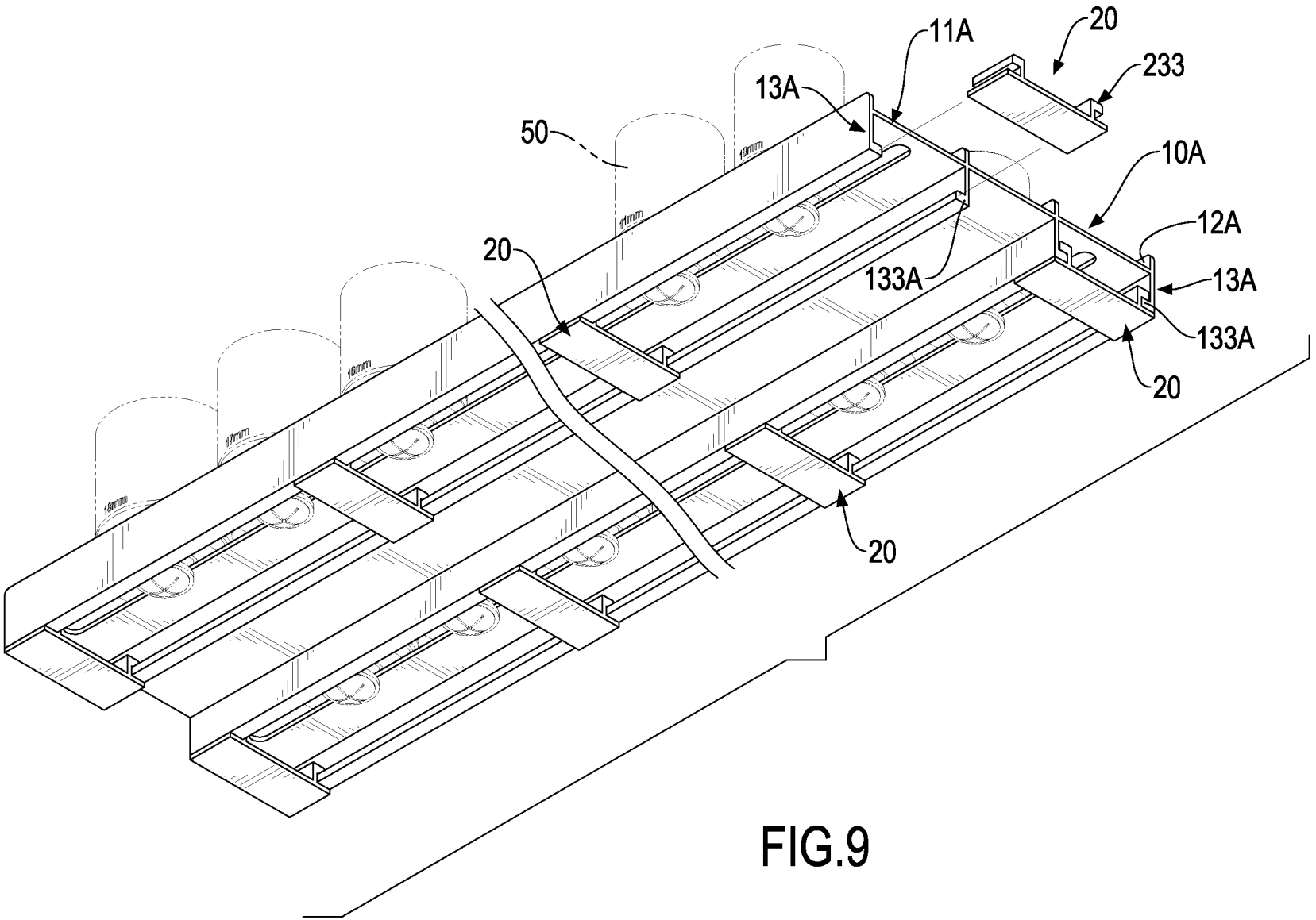
FIG. 9 is an operational perspective view of a third embodiment of a tool holding frame in accordance with the present invention.
Figure 10:
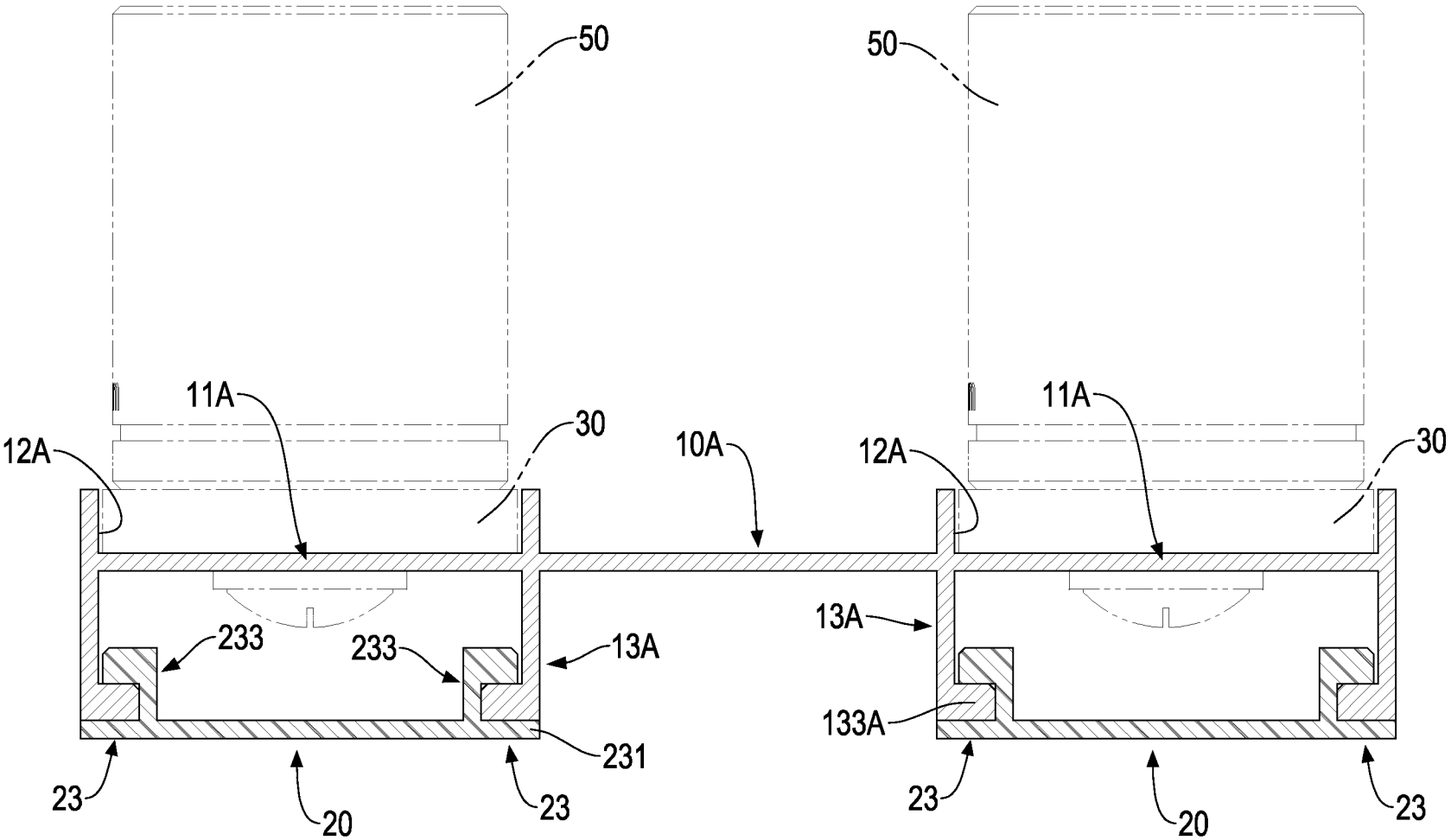
FIG. 10 is an operational side view in partial section of the third embodiment of the tool holding frame in FIG. 9.

With reference to FIGS. 9 and 10, in the third embodiment of the tool holding frame, the track base 10A has a base 11A and multiple lower portions 13A. The base 11A has multiple track channels 12A defined in a top of the base 11A. Multiple holding bases 30 are mounted in each of the track channels 12A in a linear arrangement. The lower portions 13A are formed on the bottom of the base 11A and extend along a lengthwise direction of the base 11A. Each of the lower portions 13A has two engaging tabs 133A extending along the base 11A. Multiple protective pads 20 are engaged with the two engaging tabs 133A of each of the lower portions 13A. Each of the two engaging portions 23 of each of the protective pads 20 has a bottom segment 231 and a hook 233.

Figure 11:
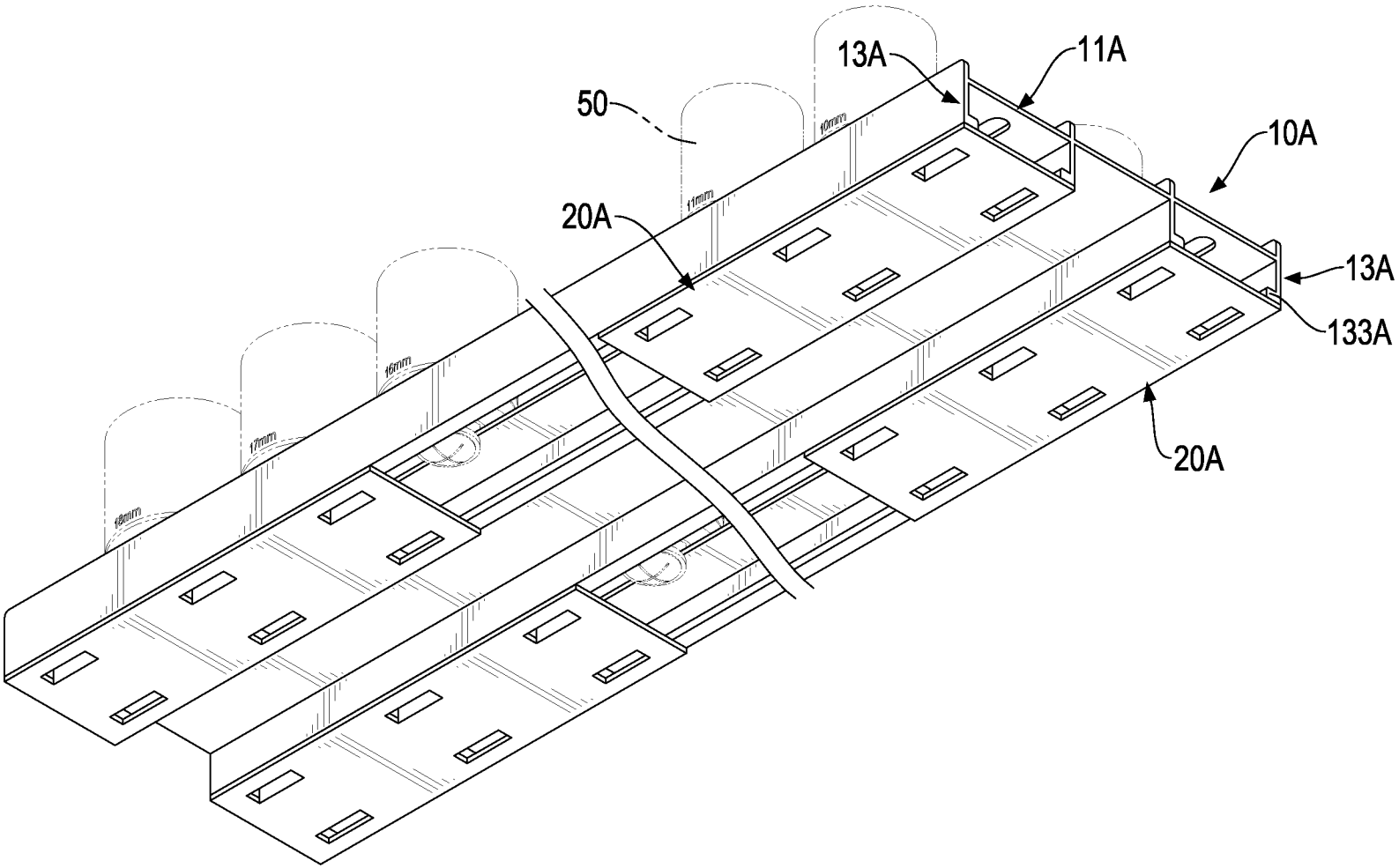
FIG. 11 is an operational perspective view of a fourth embodiment of a tool holding frame in accordance with the present invention.
Figure 12:
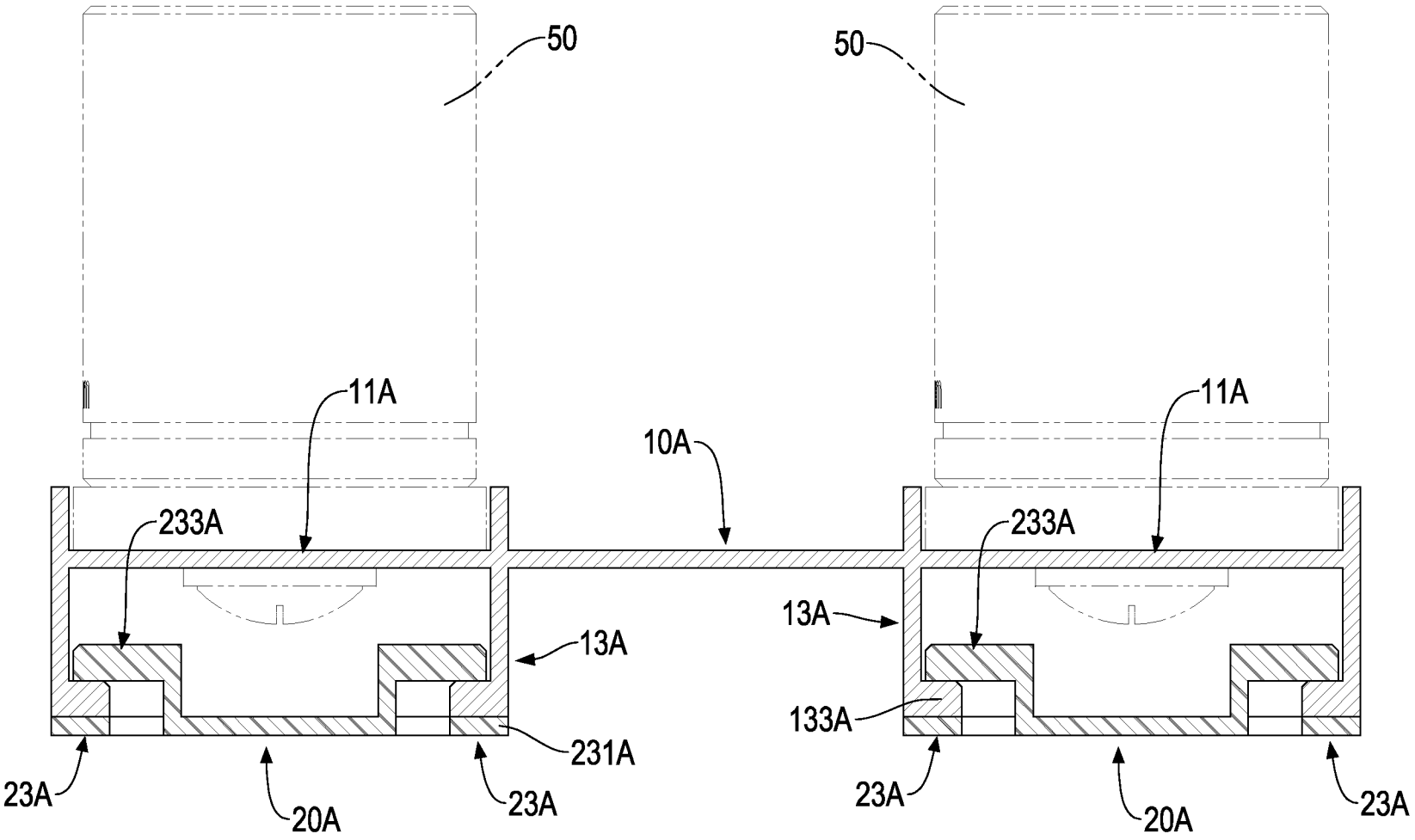
FIG. 12 is an operational side view in partial section of the fourth embodiment of the tool holding frame in FIG. 11.

With reference to FIGS. 11 and 12, in the fourth embodiment of the tool holding frame, the track base 10A has a base 11A and multiple lower portions 13A. Multiple protective pads 20A are engaged with the two engaging tabs 133A of one of the lower portions 13A. Each of the two engaging portions 23A of each of the protective pads 20A has a bottom segment 231A and multiple hooks 233A arranged along the bottom segment 231A.

With such arrangement as mentioned in the embodiments, when put on a table, the tool holding frame contacts a table surface of the table via the protective pads 20, 20A made of plastic to prevent the metal track base 10, 10A directly contacting and scratching the table surface. The protective pads 20, 20A have simple structures, are easily mounted on the bottom of the lower portion 13, 13A from one of the two opposite ends of the lower portion 13, 13A, and can be slid along the two engaging tabs 133, 133A of the lower portion 13, 13A to adjust the positions of the protective pads 20, 20A relative to the lower portion 13, 13A.

What is claimed is:

1. A tool holding frame comprising:

a track base being elongated, made of metal, and having a base being elongated; and a lower portion formed on a bottom of the base, extending along a lengthwise direction of the base, and having two engaging tabs formed on a bottom of the lower portion, extending along the lengthwise direction of the base, extending toward each other, spaced from the base to form two lower channels respectively between the base and the two engaging tabs, and spaced from each other to form a bottom opening between the two engaging tabs; and at least one protective pad made of plastic, slidably mounted on the bottom of the lower portion, engaged with the two engaging tabs of the lower portion of the track base, and each of the at least one protective pad having a body; and two engaging portions respectively formed on two opposite sides of the body and respectively engaged with the two engaging tabs of the lower portion, each of the two engaging portions having a bottom segment extending away from the other one of the two engaging portions and abutting against a bottom of a corresponding one of the two engaging tabs of the lower portion; and at least one hook formed on a top of the bottom segment, engaged with the corresponding one of the two engaging tabs of the lower portion, and each of the at least one hook having a connection segment formed on the top of the bottom segment; and a hooking protrusion extending from the connection segment and away from the other one of the two engaging portions, spaced from the bottom segment of the engaging portion to form an engaging groove between the bottom segment and the hooking protrusion of each of the at least one hook of each of the two engaging portions, and abutting against a top of the corresponding one of the two engaging tabs of the lower portion to engage with the corresponding one of the two engaging tabs of the lower portion.

2. The tool holding frame as claimed in claim 1, wherein the tool holding frame comprises multiple said protective pads engaged with the two engaging tabs of the lower portion of the track base and arranged at spaced intervals.

3. The tool holding frame as claimed in claim 1, wherein each of the two engaging portions of each of the at least one protective pad has one said hook.

4. The tool holding frame as claimed in claim 2, wherein each of the two engaging portions of each of the protective pads has one said hook.

5. The tool holding frame as claimed in claim 4, wherein a length from an end of the bottom segment of each of the two engaging portions of each of the protective pads to the connection segment of the hook of the engaging portion of the protective pad is larger than a length from an end of the hooking protrusion of the hook of the protective pad to the connection segment of the hook of the protective pad.

6. The tool holding frame as claimed in claim 1, wherein each of the two engaging portions of each of the at least one protective pad has multiple said hooks arranged along the bottom segment of the engaging portion at spaced intervals and aligned with each other.

7. The tool holding frame as claimed in claim 2, wherein each of the two engaging portions of each of the protective pads has multiple said hooks arranged along the bottom segment of the engaging portion at spaced intervals and aligned with each other.

8. The tool holding frame as claimed in claim 1, wherein bottom surfaces of the bottom segments of the two engaging portions of each of the at least one protective pad are aligned with a bottom surface of the body of each of the at least one protective pad.

9. The tool holding frame as claimed in claim 2, wherein bottom surfaces of the bottom segments of the two engaging portions of each of the protective pads are aligned with a bottom surface of the body of each of the protective pads.

* * * * *